United States Patent [19]

Headrick

[11] Patent Number: 4,461,484

[45] Date of Patent: Jul. 24, 1984

[54] FLYING DISC ENTRAPMENT ASSEMBLY

[76] Inventor: Edward E. Headrick, 808 Bevins St., Unit 3, Lakeport, Calif. 95453

[21] Appl. No.: 559,709

[22] Filed: Dec. 9, 1983

[51] Int. Cl.[3] ..... A63B 67/06

[52] U.S. Cl. ..... 273/400

[58] Field of Search ..... 273/400, 404, 410, 424

[56] References Cited

U.S. PATENT DOCUMENTS

| | | | |
|---|---|---|---|
| 3,100,115 | 8/1963 | Breneman | 273/410 |
| 3,720,411 | 3/1973 | De Vogelhere | 273/404 |
| 4,039,189 | 8/1977 | Headrick et al. | 273/424 X |

*Primary Examiner*—Paul E. Shapiro

*Attorney, Agent, or Firm*—Jackson, Jones & Price

[57] ABSTRACT

An entrapment assembly for use in a flying disc golf game. The entrapment assembly in one of its embodiments comprises an upright post mounted in the ground. An upwardly opening basket is mounted on the post and a plurality of outside chains are mounted on the post so that the lower ends thereof extend into the basket. The outside chains serve to absorb kinetic energy from a disc thrown against the assembly and thereby reduces its forward velocity. A disc deflection surface, such as a group of inside chains, extend outwardly and upwardly from a location adjacent the top of the basket to deflect the disc toward the basket after it has impacted the outside chains to ensure that the disc is caught in the basket.

9 Claims, 5 Drawing Figures

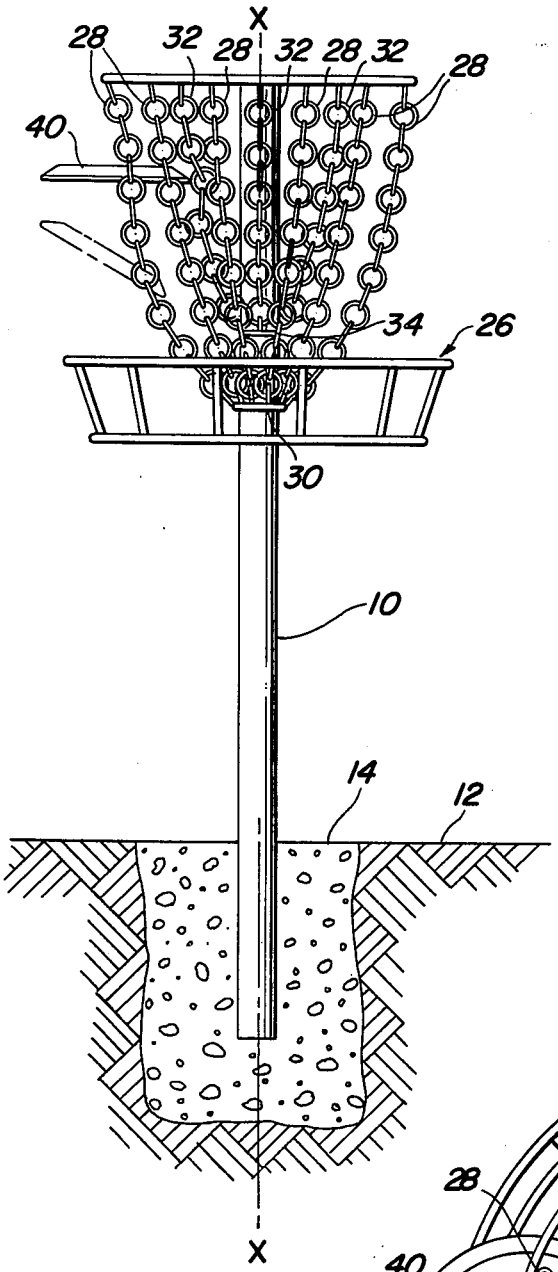
FIG. 1
FIG. 2
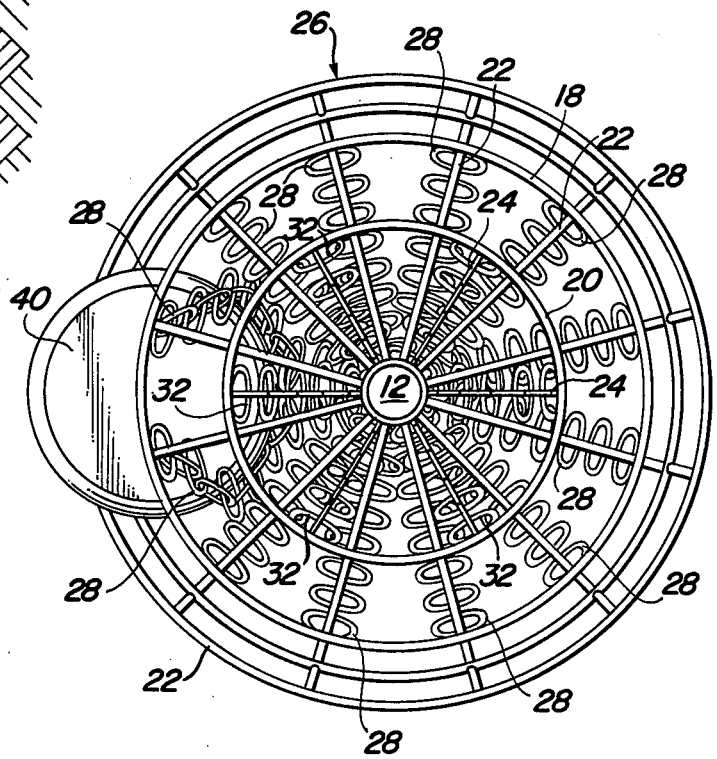

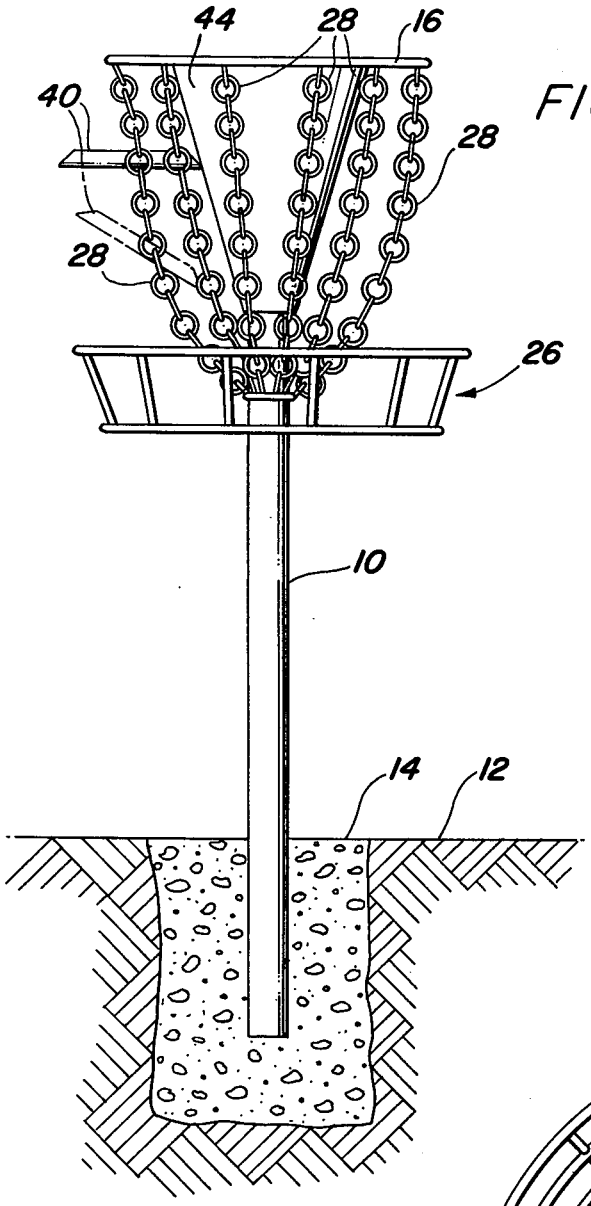
FIG. 4
FIG. 5
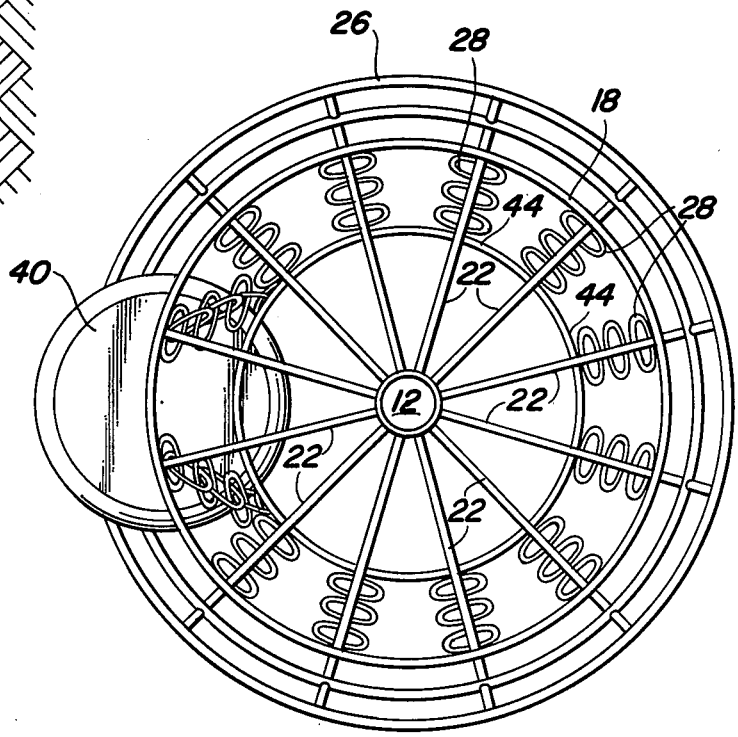

FLYING DISC ENTRAPMENT ASSEMBLY

BACKGROUND OF THE INVENTION

Flying disc golf games have been become popular. Such games are played on courses laid out in parks or other recreational areas. The courses consist of a number of "holes" such as nine or eighteen, with each hole having a "tee" from which a flying disc is originally thrown by each player and a post positioned a selected distance from the tee.

In playing the game, the flying disc is thrown from each of the tees in the direction of the respective post. If the disc misses the post by landing short, etc. on the first throw, as is generally the case, the disc is picked up and thrown again. This process is repeated until the disc strikes the post. The number of throws required for each player to strike each of the posts are then added to provide the total score for that player. The player with the lowest score is the winner.

Since obstacles such as trees, etc. are often located between the tees and their respective posts it is necessary to ensure by means other than visual observation that each impact between a disc and a post is accurately determined. Entrapment devices for use in the game and which are designed to capture a disc which impacts a post are known in the prior art. See, for example, U.S. Pat. No. 4,039,189 (of which I am a co-inventor). The device disclosed in this patent includes a post with an inverted basket mounted on the post, and a group of chains (8 or more) with the upper ends thereof mounted above the basket in a circle and the lower ends extending into the basket. The device described in the above patent, while functioning very satisfactorily with large, lightweight discs (e.g., 23 centimeters or more in diameter and about 100 grams in weight), does not always capture discs which are smaller and heavier. Smaller and heavier discs, for example, having a diameter of 21 centimeters (cm) and a weight up to 175 grams, when thrown travel faster and farther than the large, lightweight discs. For this reason the smaller, heavier discs have become very popular for use in the game. However, it has been observed that a disc of 21 cm diameter and weighing approximately 175 grams has enough kinetic energy to separate the chains, hit the post of the prior art device and bounce back several feet or separate the chains, miss the post and exit through the chains on the other side. In either event the entrapment device does not capture the disc and the unlucky player's score will be greater than it should be.

Another type of disc entrapment device which has been used in the past includes an inverted cone mounted on a post with the smaller end of the cone extending into an inverted basket also mounted on the post. It has been observed that this type of entrapment device has a tendency to deflect a disc away from the basket if the disc is traveling at a high velocity. The angle that the disc strikes the cone is also a factor in causing the disc to be deflected away from the basket in this type of prior art device.

The problems outlined above are solved to a large extent by the entrapment assembly of the present invention, which, like the prior art device of the above-referred-to patent, provides a first energy absorbing means in the form of a group of outside chains surrounding the post to reduce the velocity of the disc. An upwardly extending basket is mounted on the post so that the lower ends of the outside chains extend into the basket. In the present invention a deflection surface means, such as a second group of chains or a conical member, is positioned within the outside chains and extends upwardly and outwardly from a location adjacent the top of the basket for deflecting the disc and preferably absorbing additional kinetic energy therefrom so that small, high velocity (as well as large, lower velocity) discs will be caught in the basket.

The features of the present invention can best be understood by reference to the accompanying description taken in conjunction with the drawings where like reference numerals indicate like parts.

BRIEF DESCRIPTION OF THE DRAWINGS

FIG. 1 is an elevational view of a flying disc entrapment assembly in accordance with one embodiment of the invention, and showing a disc being caught by the assembly;

FIG. 2 is an enlarged top plan view of the assembly of FIG. 1;

FIG. 4 is an elevational view of another embodiment of the present invention; and FIG. 5 is a top plan view of the assembly of FIG. 4.

DETAILED DESCRIPTION OF THE ILLUSTRATED EMBODIMENTS

Figure 3:
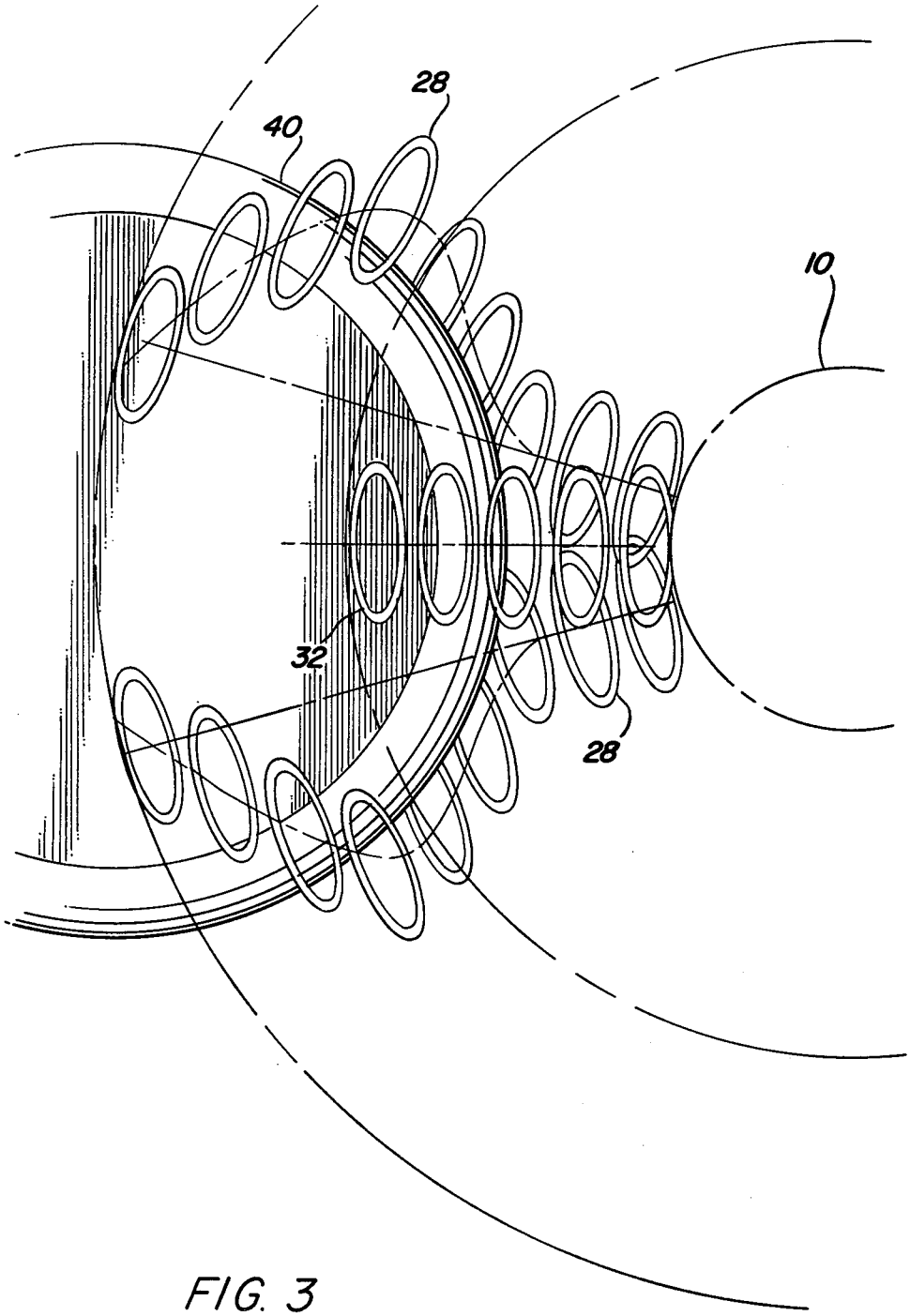
FIG. 3 is a partial plan view of the assembly of FIG. 1 enlarged to show only three of the chains being impacted by the disc.

In the embodiments of FIGS. 1 and 2, a post 10 having a longitudinal axis x—x is mounted in an upright position in the ground 12 by means of a concrete base 14. A support bracket 16 in the form of an outer annular collar 18 and an inner annular collar 20 is secured to the post 12 by means of a plurality radial support rods 22 and 24 as is shown in FIG. 2. An upwardly opening basket 26 is secured to the post below the support bracket 16. A plurality of outside chains 28 (sixteen in number) are mounted with the upper ends thereof attached at spaced annular positions (i.e., 30° apart) to the collar 18 which forms the periphery of the support bracket 16. The lower ends of the outer chains 28 are attached to a loose ring 30, which is freely mounted on the post 10 within the confines of the basket 26.

A plurality of inside chains 32 (six in number) are mounted with the upper ends thereof attached at spaced annular positions (i.e., 60° apart) to the inner bracket 20 of the support bracket 16. The lower ends of the inside chains 20 are attached to a second ring 34 which is also freely mounted on the post 10. The length of the inside chains allows the ring 34 to assume a position adjacent to or slightly above the top of the basket 26. While the upper ends of the inside chains 24 are illustrated in FIG. 2 as being attached to the collar 20 at a location between the outside chains 28, it should be noted that the upper ends of the inside chains can be connected, if desired, to the same radial support rods 22 to which the outside chains are secured. Also, the number of inside chains may be made equal to the number of outside chains. The upper ends of the inside chains are preferably located at approximately two-thirds of the distance from the center of the post to the upper ends of the outside chains.

In the preferred embodiment of the disc entrapment assembly of FIG. 1 the basket has an outer diameter of about twenty-four inches, the support bracket 16 has an outer diameter of approximately twenty-one inches. The distance between the support bracket 16 and the top of the basket 26 is about twenty inches. The ring 34 in the preferred embodiment is preferably located at a position from about level with the top of the basket 26 up to about six inches above the top of the basket.

Referring again to FIGS. 1 and 2, a disc 40 is illustrated as impacting the entrapment assembly, and separating two of the outside chains 28 and impacting one of the inside chains 32. FIG. 3 illustrates and depicts in diagramatic form only the two outside chains 28 and one of the inside chains 32, which are contacted by the disc 40. The outside chains function to absorb kinetic energy from the disc as it strikes the assembly, thereby reducing its velocity. The inside chains 32 form a disc deflection surface means positioned within the outside chains to slow the forward motion of the disc by absorbing additional kinetic energy therefrom and to deflect the disc downwardly toward the basket so that it will be caught therein. The inside chains 32, as can be seen in FIG. 1, extend upwardly and outwardly from the location adjacent to the top of the basket to the support bracket 16.

Referring now to FIGS. 4 and 5 there is illustrated an alternative embodiment of the present invention in which the inside chains 32 of FIGS. 1 and 2 are replaced by a frusto conical member 44. The member 44 functions as a disc deflection surface extending upwardly and outwardly from a location adjacent to or near the top of the basket. The frusto conical deflection member 44 may be made of metal but is preferably made of an energy-absorbing material, such as a suitable plastic. The deflection member 44 serves to deflect the disc 40 after it has impacted the outside chains 28 to ensure that it is caught in the basket. Where the member 44 is made of an energy absorbing material it serves the additional function of absorbing additional kinetic energy from the disc and arresting its forward motion.

There has thus been described a disc entrapment assembly which solves many of the problems inherent in the prior art devices and serves to reliably capture a disc which is thrown against the assembly.

Various modifications of the embodiments described herein will be obvious to those skilled in the art. The claims are intended to cover such modifications which come within the spirit and scope of my invention.

What is claimed is:

1. In an entrapment assembly for use in a flying disc game for arresting and trapping a flying disc thrown against the assembly, the combination which comprises:

(a) an upright post having a longitudinal axis;

(b) an upwardly opening basket centrally mounted on the post;

(c) a support bracket mounted on the post above the basket;

(d) a plurality of outside chains secured at a first end thereof to the bracket at spaced annular points around the longitudinal axis of the post, the second end of the outside chains extending into the open end of the basket, the outside chains being adapted to absorb kinetic energy of the disc and reduce its velocity; and (e) deflection surface means positioned within the outside chains and extending outwardly from a location about adjacent the top of the basket to the support bracket, the deflection surface means being arranged symmetrically with respect to the longitudinal axis of the post and arranged to deflect the disc downwardly toward the basket after it has impacted the outside chains.

2. The invention of claim 1 wherein the top of the deflection surface means adjacent the support bracket extends outwardly from the longitudinal axis of the post about two-thirds of the distance to the first end of the outside chains.

3. The invention of claim 2 wherein the deflection surface means comprises a frustro conical shaped deflection member.

4. The invention of claim 3 wherein the deflection member is constructed of an energy absorbing material.

5. the invention of claim 1 wherein the deflection surface means comprises a plurality of inside chains secured at one end thereof to the bracket at spaced annular points around the longitudinal axis of the post and at the other end to the post adjacent the top of the basket.

6. The invention of claim 5 wherein the number of outside chains equals approximately twice the number of the inside chains.

7. The invention of claim 5 wherein the outside chains are twelve in number and the inside chains are six in number.

8. An entrapment assembly for use in a flying disc game for arresting and trapping a flying disc thrown against the assembly comprising:

(a) an upright post having a longitudinal axis;

(b) an upwardly opening annular basket mounted symmetrically on the post at an intermediate location;

(c) a circular support bracket mounted at the top of the post;

(d) a first ring mounted on the post within the basket;

(e) a plurality of outside chains having the upper ends thereof attached to the support bracket at spaced annular positions around the periphery thereof, and the lower ends thereof attached to the first ring at spaced annular positions around the periphery thereof, the outside chains being adapted to abort kinetic energy of the disc and reduce its velocity;

(f) a second ring mounted on the post at a location adjacent the upper end of the basket; and (g) a plurality of inside chains having the upper ends thereof attached to the support bracket at spaced annular positions intermediate the distance between the periphery thereof and the post, and the lower ends attached to the second ring at spaced annular positions around the periphery thereof so that the inside chains extend outwardly and from the second ring to the support bracket, the inside chains being adapted to absorb additional kinetic energy from the disc and cause it to be deposited in the basket.

9. An entrapment assembly for use in a flying disc game for arresting and trapping a flying disc thrown against the assembly comprising:

(a) an upright post having a longitudinal axis;

(b) an upwardly opening annular basket mounted symmetrically on the post at an intermediate location;

(c) a circular support bracket mounted at the top of the post;

(d) a ring mounted on the post within the basket;

(e) a plurality of outside chains having the upper ends thereof attached to the support bracket at spaced annular positions around the periphery thereof, and the lower ends thereof attached to the ring at spaced annular positions around the periphery thereof, the outside chains being adapted to abort kinetic energy of the disc and reduce its velocity; and (f) a frusto conical deflection member mounted on the post within the outer chains and having its large end positioned adjacent the support bracket and its small end positioned adjacent the upper end of the basket for deflecting the disc in a direction to be deposited in the basket after the disc has impacted the outside chains.

* * * * *